US006872186B2

(12) United States Patent
Branch et al.

(10) Patent No.: US 6,872,186 B2
(45) Date of Patent: Mar. 29, 2005

(54) APPARATUS FOR ENABLING THE MOVEMENT OF HUMAN LIMBS AND METHOD FOR USING SAME

(75) Inventors: Thomas P. Branch, Atlanta, GA (US); Alex Sattler, Marietta, GA (US)

(73) Assignee: ERMI Corporation, Decatur, GA (US)

( * ) Notice: Subject to any disclaimer, the term of this patent is extended or adjusted under 35 U.S.C. 154(b) by 0 days.

(21) Appl. No.: 10/147,434

(22) Filed: May 15, 2002

(65) Prior Publication Data

US 2003/0120186 A1 Jun. 26, 2003

Related U.S. Application Data

(60) Provisional application No. 60/291,244, filed on May 15, 2001.

(51) Int. Cl.[7] ..... A61H 1/02; A63B 21/04

(52) U.S. Cl. ..... 601/5; 601/26; 601/29; 601/34; 482/130; 482/142

(58) Field of Search ..... 601/5, 23, 24, 601/26, 27, 29–32, 34, 35; 482/130, 142

(56) References Cited

U.S. PATENT DOCUMENTS 2,024,670 A * 12/1935 Volf ..... 601/24
2,030,358 A * 2/1936 Dorrance ..... 601/29
2,668,709 A * 2/1954 Boyko ..... 601/27
3,000,632 A * 9/1961 Fuchs ..... 601/24
3,730,174 A * 5/1973 Madison ..... 601/26
3,906,942 A 9/1975 Lumb, Jr. et al.
3,911,908 A * 10/1975 Duke ..... 601/32
4,222,376 A * 9/1980 Praprotnik ..... 601/24
4,229,001 A * 10/1980 Roman ..... 482/79
4,509,509 A * 4/1985 Bouvet et al. ..... 601/15
4,621,620 A * 11/1986 Anderson ..... 601/34
4,637,379 A * 1/1987 Saringer ..... 601/34
4,665,899 A * 5/1987 Farris et al. ..... 601/33
4,825,852 A * 5/1989 Genovese et al. ..... 601/34
4,834,073 A * 5/1989 Bledsoe et al. ..... 601/34
4,930,497 A * 6/1990 Saringer ..... 601/34
5,228,432 A * 7/1993 Kaiser et al. ..... 601/34
5,239,987 A * 8/1993 Kaiser et al. ..... 601/34
5,399,147 A * 3/1995 Kaiser ..... 601/34
6,221,033 B1 * 4/2001 Blanchard et al. ..... 601/34

* cited by examiner

*Primary Examiner*—Danton DeMille
(74) *Attorney, Agent, or Firm*—Alston & Bird, LLP

(57) ABSTRACT

An orthotic apparatus for use in providing improved range of motion is provided which allows the amount of stretch to be hydraulically powered and measured by the device, but controlled by the user. Because the apparatus accurately calculates the amount of stretch, the user, together with the user's physician and therapist, can develop a rehabilitation plan based on accurate measurements. Progress is based on tangible results rather than the user's ability to tolerate pain. This knowledge provides the incentive the user needs to work toward and achieve the user's goal.

3 Claims, 9 Drawing Sheets

APPARATUS FOR ENABLING THE MOVEMENT OF HUMAN LIMBS AND METHOD FOR USING SAME

CROSS-REFERENCE TO RELATED APPLICATION

This application claims the full benefit and priority of pending prior application No. 60/291,244, filed May 15, 2001, entitled APPARATUS FOR ENABLING THE MOVEMENT OF HUMAN LIMBS AND METHOD FOR USING SAME, and incorporates said application by reference.

FIELD OF THE INVENTION

The present invention relates generally to an orthotic apparatus for enabling the full normal motion of a joint as an alternative to surgical manipulation.

BACKGROUND OF THE INVENTION

The number one complication of a joint injury is loss of motion. The loss of motion is often due to an excess production of fibrous tissue within the joint called arthrofibrosis. Arthrofibrosis is both a mechanical and a biological process, which results in loss of motion of a joint.

Synovial cells make up the lining of a joint. These cells are the source of the problem called arthrofibrosis. The synovial cells transform themselves into fibroblasts upon exposure to cytokines and growth factors produced by damaged vascular endothelium. Sudden increases in range of motion produced by intermittent vigorous physical therapy or intra-operative manipulation cause bleeding within the joint further exposing the synovial cells to the cytokines and growth factors which cause arthrofibrosis.

The current methods for gaining range of motion in joints with early or late arthrofibrosis include vigorous physical therapy, specialized splints, continuous passive motion machines and surgical manipulation under anesthesia. Unfortunately, vigorous physical therapy and surgical manipulation under anesthesia have a high failure rate associated with peri-articular bleeding and the resultant progression of arthrofibrosis. Continuous passive motion machines are not effective as they spend most of the time in the middle range of motion of the joint and not focused on stretching at end range of motion.

The current specialized splints include serial casting, Dynasplint and the Joint Active System, on which the invention will provide personal opinions. All of these splints enclose the limb segment proximal and distal to the joint that needs to be stretched. Furthermore, the Dynasplint allows for only a low load stretching process. The Joint Active Systems devices allow for higher loads to be placed at the joint but at the expense of increased pressure at the limb segments proximal and distal to the joint. The loads used by the Joint Active Systems are low in intensity. Serial casting splints are not removable by the patient and have limited adjustability to change the load placed at the joint. Due to the splint design of these devices energy is trapped within the structure of the splints during the stretching process. As a result there is an unpredictable variation in load seen by the joint during the stretching process. This 'unpredictability' creates a sense of unease in the patient using the device to gain range of motion. None of these devices produce a load high enough to assure that for every degree the device moves the joint moves the same amount. Finally, none of these devices allow for an instantaneous or quick release of the load applied to the joint.

There is a need to produce an orthotic device for the treatment of arthrofibrosis, which can stretch the joint into full normal end range of motion in a predictable, consistent and reliable fashion. This device should be rigid enough to not allow the storage of energy within its structure. Furthermore, it should be able to produce a load at the joint high enough to assure that for every degree the device moves the joint moves the same amount. Finally, this orthotic device should allow for instantaneous or quick release of the load applied to the joint.

SUMMARY OF THE INVENTION

The orthotic device according to the present invention (a.k.a. "inventive device" allows the user to achieve full normal flexion of the knee or ankle while maintaining absolute control of the process. Furthermore, the inventive device produces a sufficient load at the knee or ankle such that for every degree the inventive device moves the knee or ankle moves the same degree. Furthermore, this device allows for measured progress in terms of distance of the heel to the buttock which is the most reliable measure of knee flexion.

The inventive device provides knee flexion to the point where the heel touches the buttock of the patient. This can amount to well over 145 degrees depending upon the patients normal anatomy. The load is applied to the bottom of the foot and the lower back/buttock region of the patient. These areas are used to increased pressure as opposed to the skin on the anterior aspect of the shin or the thigh. Amount of stretch is patient controlled with a hydraulic hand pump and an instantaneous or quick release mechanism which can stop and reverse the load applied to the joint at any moment. Unlike other range of motion devices; the inventive device provides a very high load to a joint in tiny increments, which helps stretch soft tissue without tearing it causing more vascular re-injury. The inventive device is operated hydraulically and does not rely on any electrically powered parts. The inventive device is solid, sturdy and safe.

By making the ankle pivot of the inventive device stationary and providing a heel lock feature, a particular motion of the device transfers load to the ankle causing the ankle to dorsiflex as the knee flexes. When the knee has normal range of motion all of the load is transferred to the ankle and ankle dorsiflexion is achieved in a similar fashion to knee flexion.

The inventive device is believed to be the best and only non-operative method for regaining full flexion in the most difficult patients following any type of knee or ankle injury or surgery.

In a follow up study of 96 patients who failed the use of traditional methods to regain knee flexion post-operatively (including surgery), the use of the inventive device was successful in regaining functional knee flexion in 95% and full knee flexion in greater than 90%.

The amount of stretch is hydraulically powered with up to 30 times more torque at the knee than any other range of motion product on the market. This high powered stretch is fully controlled by the patient. Heel to buttock measurement insures an easy and accurate day to day evaluation of the patient's progress. This progress is based on tangible results rather than the ability to tolerate pain. This knowledge provides the incentive needed to work toward and achieve goals.

Operation is as follows. The patient sits in the device 4–8 times per day using the hydraulic pump to pull the knee into flexion for 1 to 5 minutes of stretch with an equal amount of time spent in a relaxed position for joint recovery for a total of 15 minutes per session. At the end of the session the position of the foot pedal on the measuring tape is noted and helps to determine the goals for the next session. The goals for each session are to stretch the soft tissues causing the restriction in range of motion of the knee without tearing these structures causing vascular re-injury. The physician must direct this treatment protocol as there are distinct contra-indications for the use of this device, e.g. restricted ankle range of motion, restricted hip range of motion, presence of a total hip arthroplasty or a total ankle arthroplasty, or a technical or mechanical issue restricting range of motion of the knee. All of these contra-indications are of great concern considering that this device can develop from less than 1 ft-lb of torque up to 750 ft-lbs of torque at the knee.

When using this device for ankle dorsiflexion it is assumed that knee flexion is normal. The ankle pivot on the foot pedestal is fixed in the appropriate position so that as the knee is flexed the load is applied to the ankle causing ankle dorsiflexion. The protocol is similar to that described for the knee.

Therefore, it is an object of the present invention to provide an improved orthotic device.

It is a further object of the present invention to provide an improved orthotic device object which is easy to operate.

It is a further object of the present invention to provide an improved orthotic device object which is simple in design.

It is a further object of the present invention to provide an improved orthotic device object which is readily stored.

Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

Figure 1:
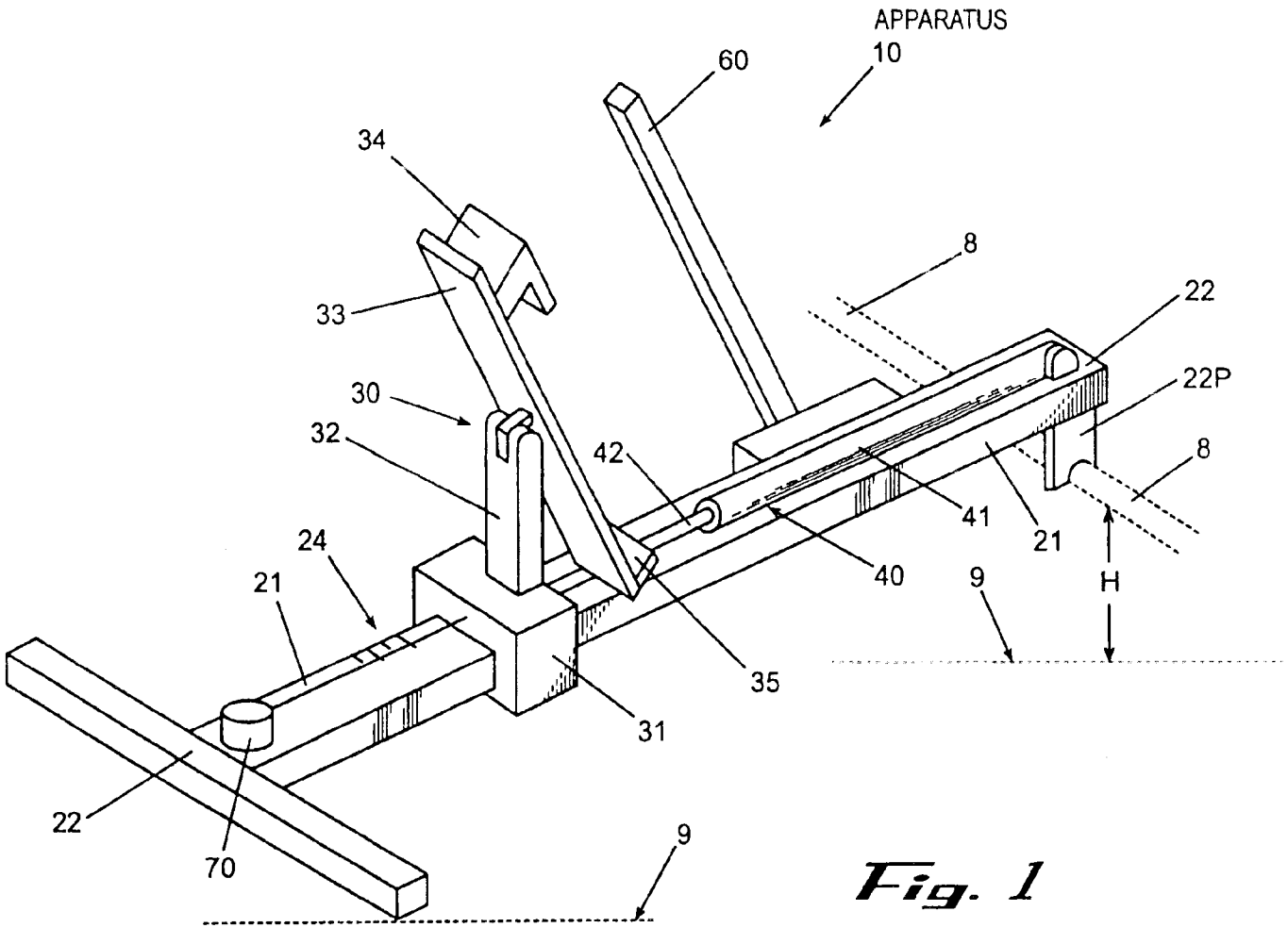

Having thus described the invention in general terms, reference will now be made to the accompanying drawings, which are not necessarily drawn to scale, and wherein:

FIG. 1 is an overall pictorial view of the apparatus 10 according to the present invention.

Figure 2:
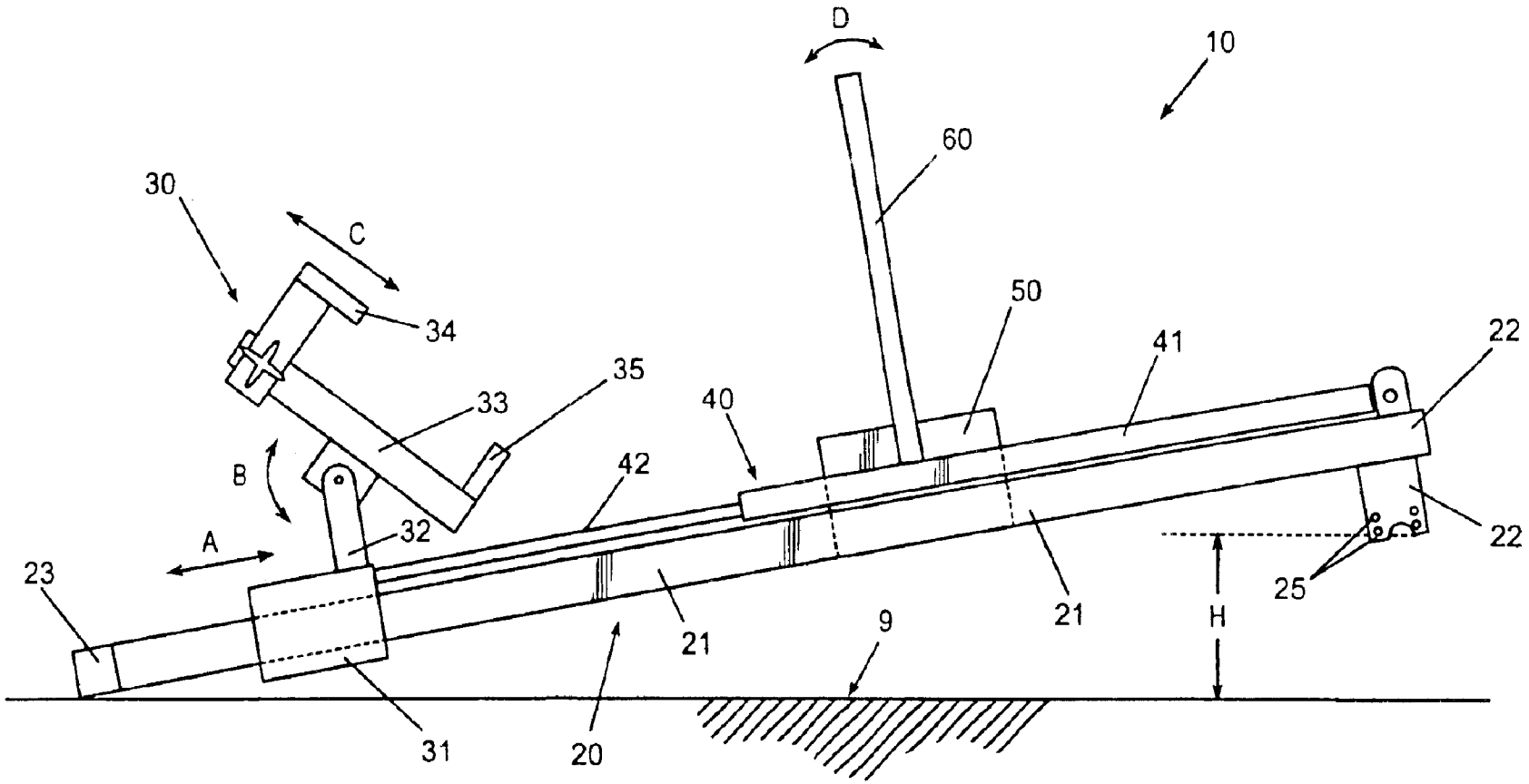

FIG. 2 is a side elevational view of the apparatus 10 according to the present invention, having one (leftward) end positioned atop a supporting surface 9. The other (rightward) end is shown as if suspended in air, but in fact this end is supported a distance height "H" above the supporting surface 9, by use of a separate chair, which is not shown in this figure.

Figure 3:
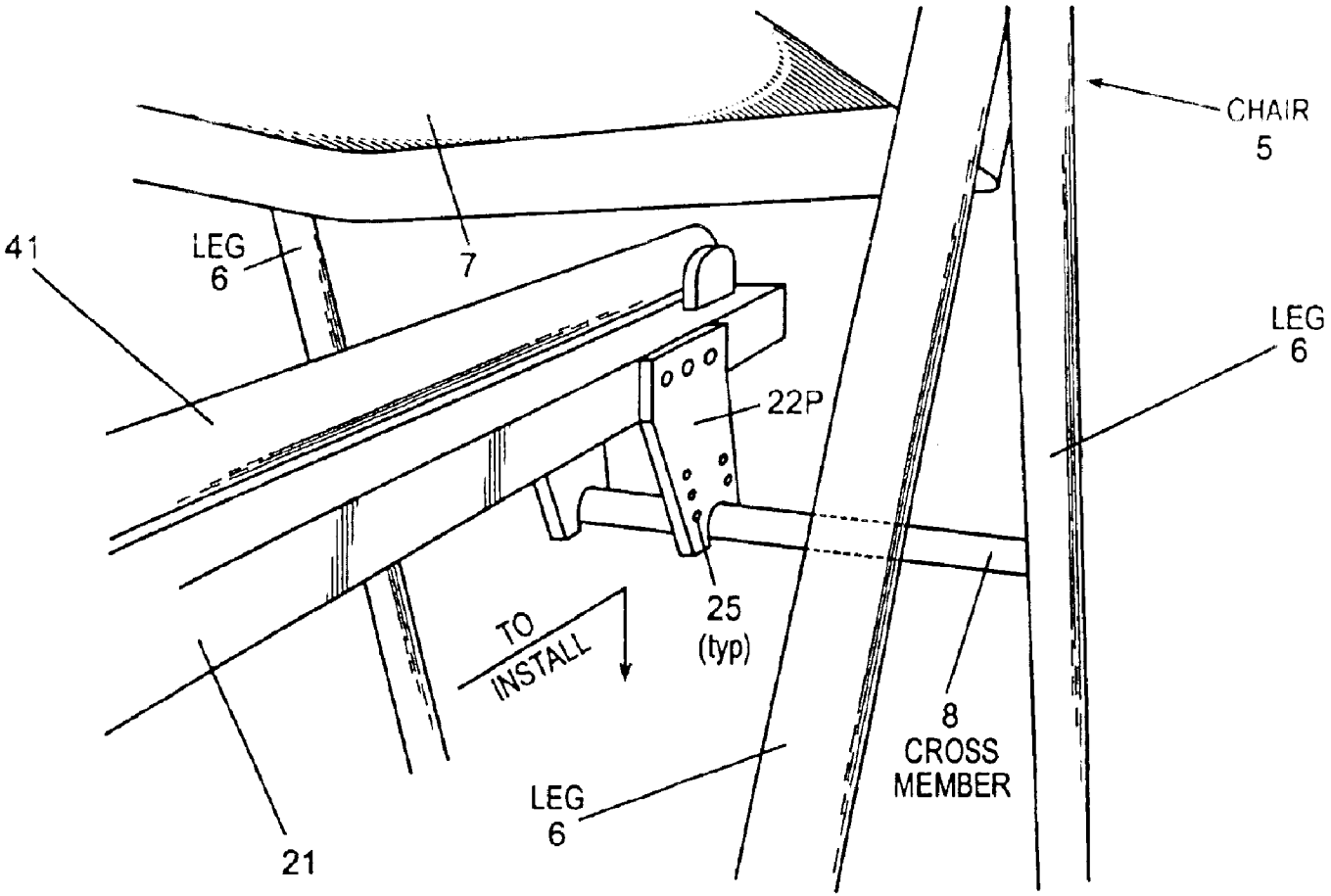

FIG. 3 is a partial pictorial view of the head end 22 of the frame 20 of the apparatus 10, being supported by a cross member 8 of a chair 5

Figure 4:
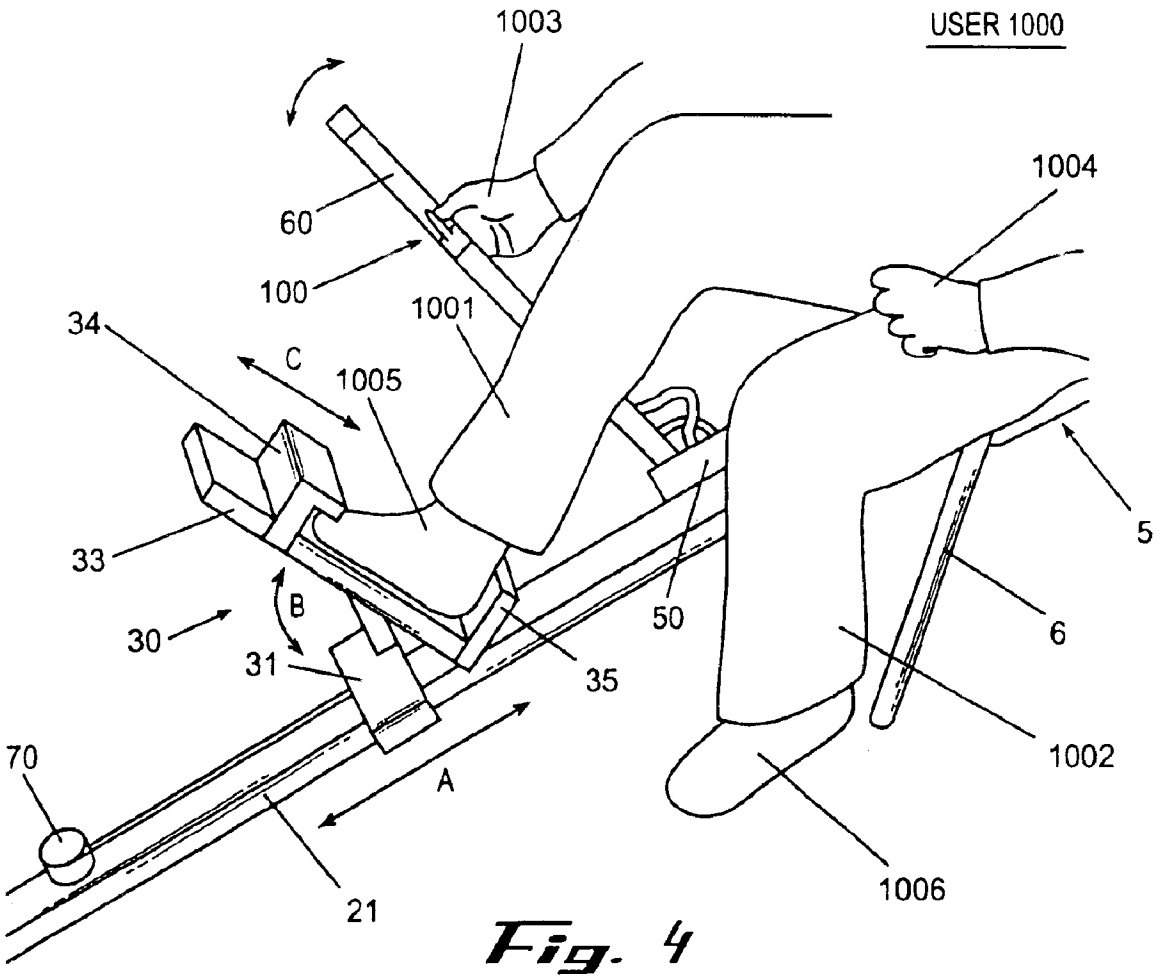

FIG. 4 is a partial pictorial view of the combination of the apparatus 10 with a chair 5, with a user 1000 seated in the chair and having the user's right leg positioned atop the apparatus 10. The user's right hand 1003 is holding the manual pump member 60, and the user's right hand thumb is positioned adjacent the switch 1000.

Figure 5:
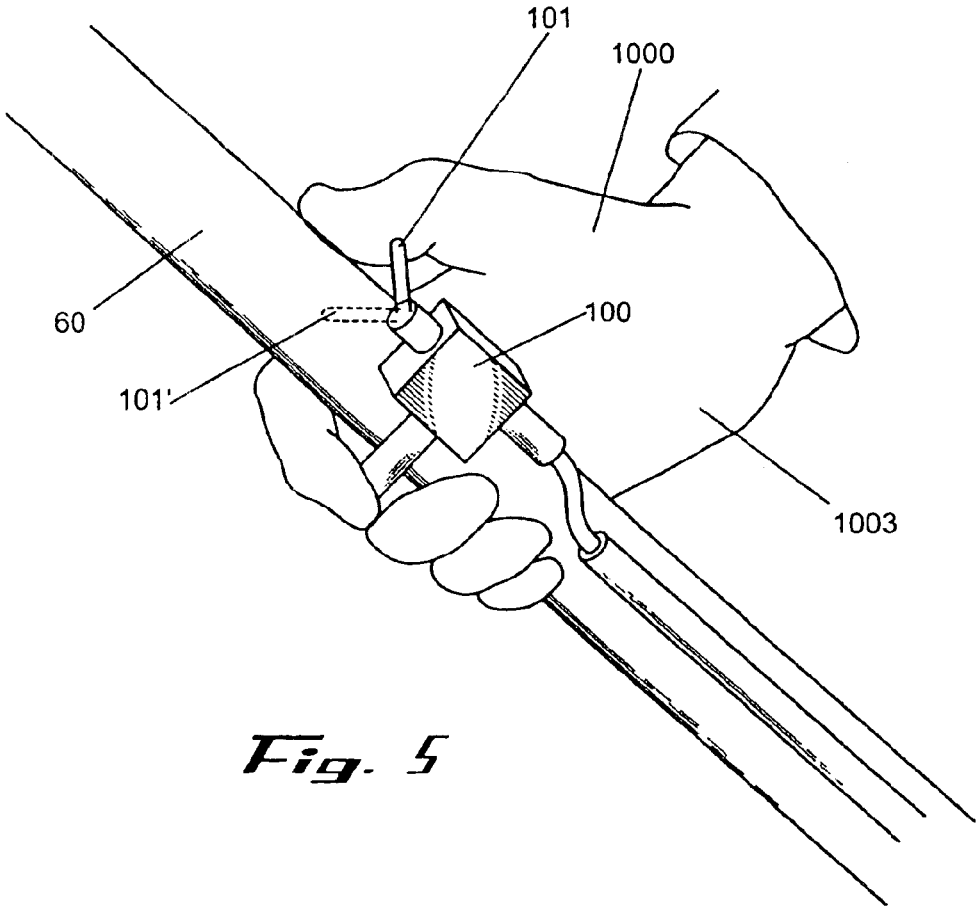

FIG. 5 is a partial pictorial view of the right hand 1003 of a user 1000 grasping the pump member 60, and positioned to manipulate the switch 1000 including toggle 1001 (having an alternate position 1001).

Figure 6A:
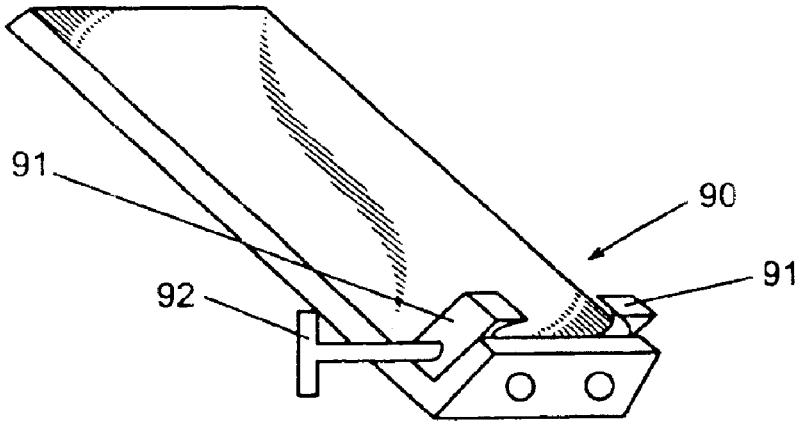
Figure 6B:
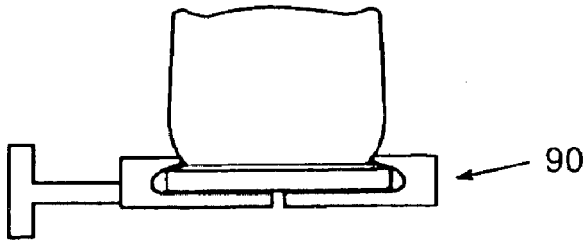
Figure 6C:
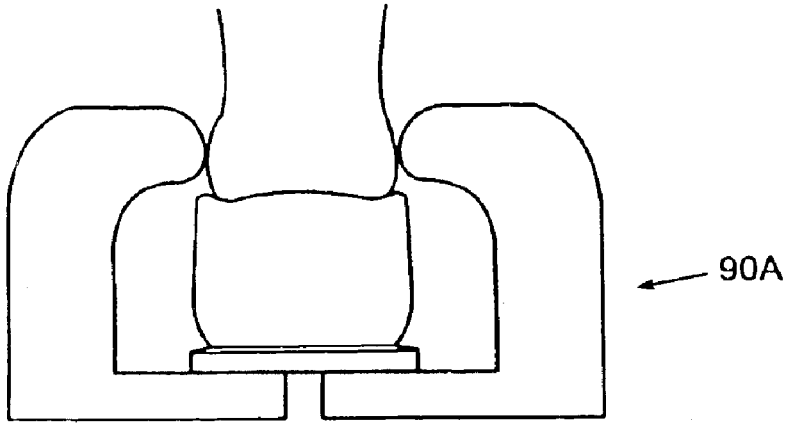

FIGS. 6A, 6B, and 6C are related drawings showing the use of a heel lock concept.

FIG. 6A shows a foot support pad 33 including a heel lock apparatus 90 including grasping members 91 and an adjustment member 92. The Heel Lock System shown grabs a regular lace up shoe at the heel and keeps the heel from raising up on the foot plate as dorsiflexion of the ankle is achieved.

FIG. 6B shows the heel lock apparatus 90 attached to the sole of the shoe of a wearer. This shoe might be a conventional shoe, or may be a special shoe. The Heel Lock system clamps on to the sole of the patient's shoe. FIG. 6C shows an alternative heel lock apparatus 90A which grasps the entire shoe of the wearer.

Figure 7:
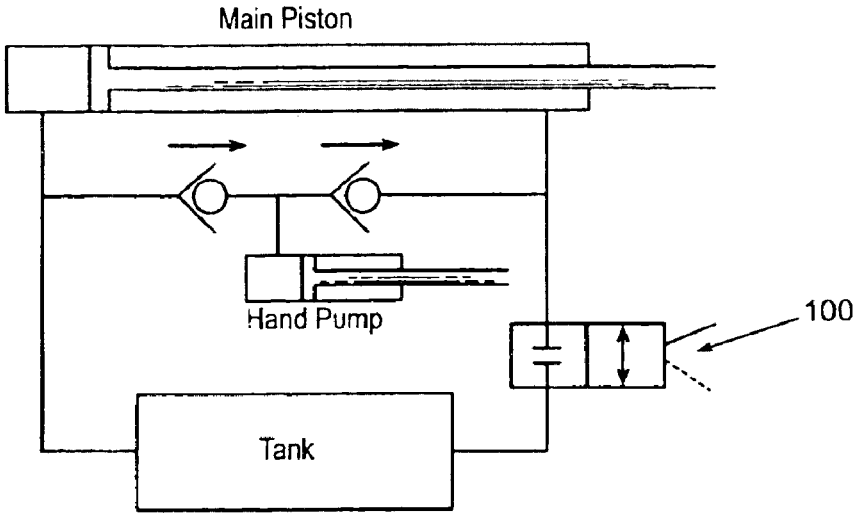

FIG. 7 is a hydraulic system layout which illustrates a "Version One" layout. This shows the Knee Flexionator Hydraulic System Schematics.

Figure 8:
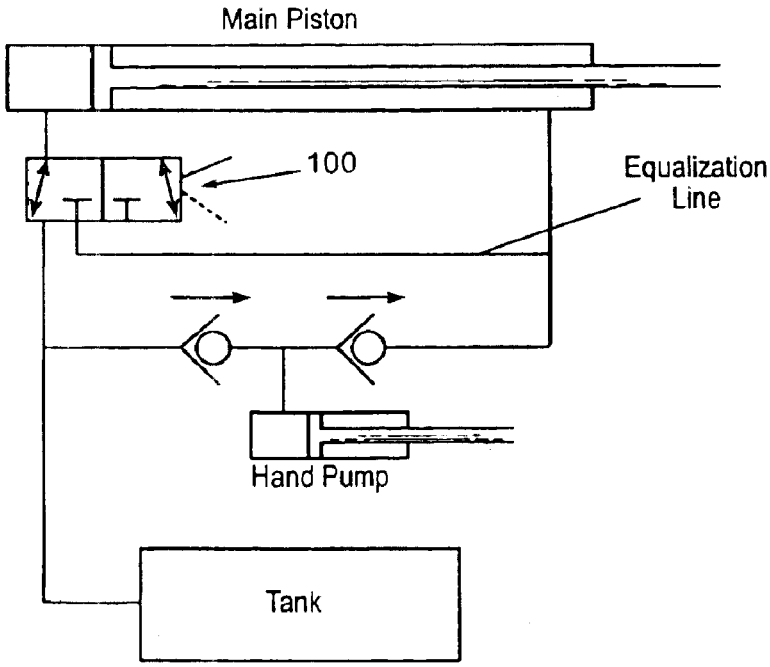

FIG. 8 is a hydraulic system layout which illustrates a "Version Two" layout. This shows the Knee Flexionator Hydraulic System Schematics, particularly the new hydraulic schematic of the ERMI Inc. Knee Flexionator(™) system. It uses the switch to redirect flow to both cylinders during use of the hand pump causing the piston to reposition without the need for the spring loaded return device.

Figure 9:
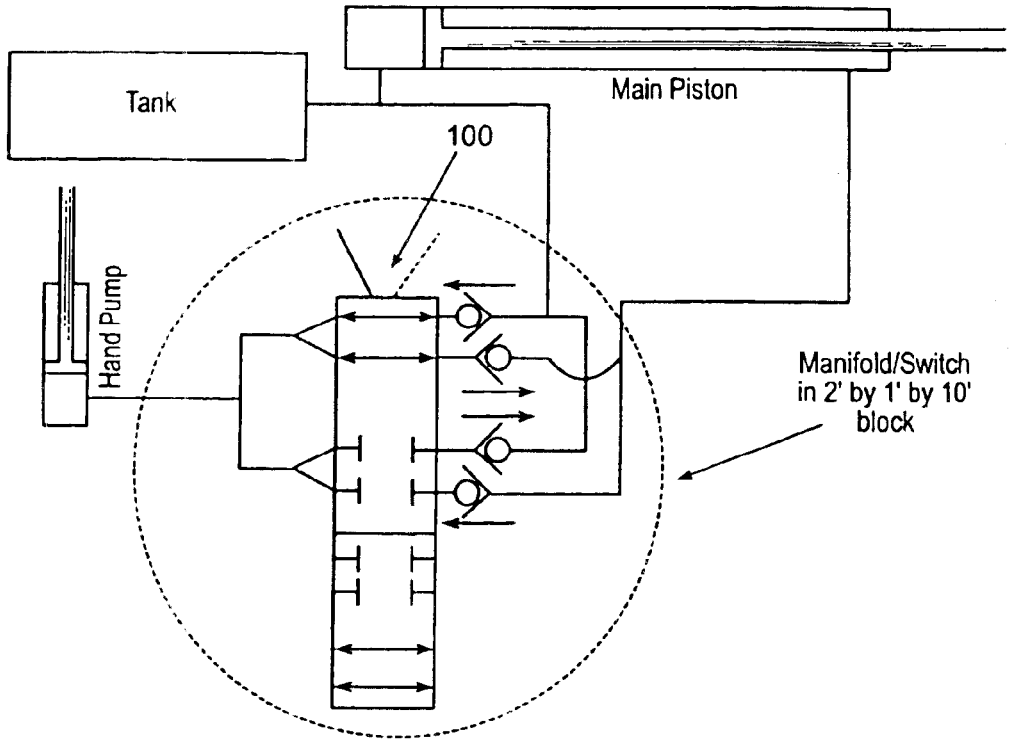

FIG. 9 a hydraulic system layout which illustrates a "Version Three" layout. This shows the Knee Flexionator Hydraulic System Schematics; this system bypasses the need for the extension spring. The patient would pump the knee into extension.

Figure 10:
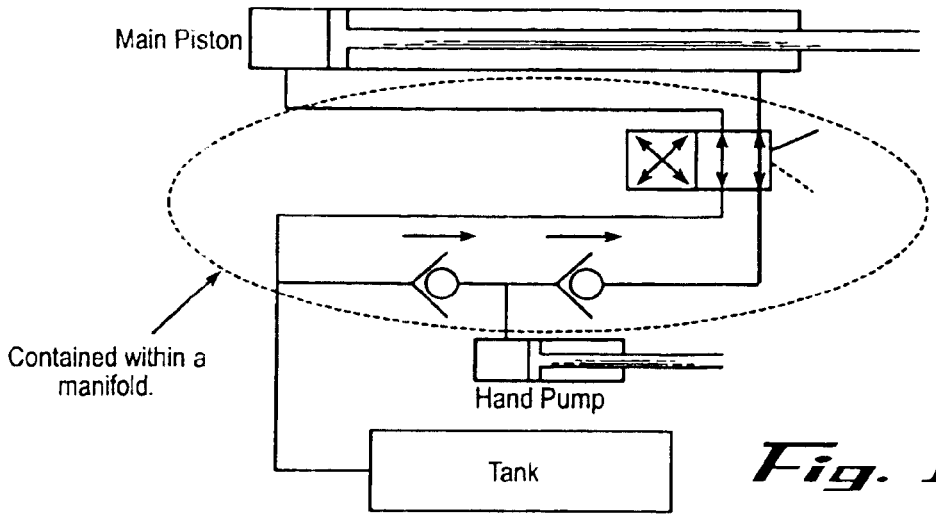

FIG. 10 is a hydraulic system layout which illustrates a "Version Four" layout. This illustrates the Knee Flexionator Hydraulic System Schematics.

Figure 11:
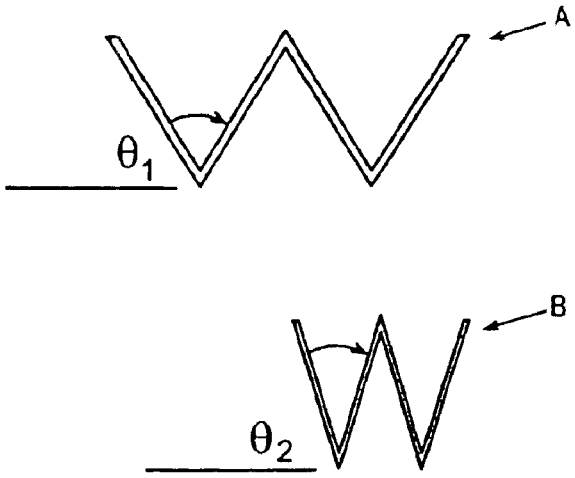

FIG. 11 is an illustrative view of an illustrative accordion action. Theta (1) and (2) show different angles at which the foot plate can be fixed.

Figure 12:
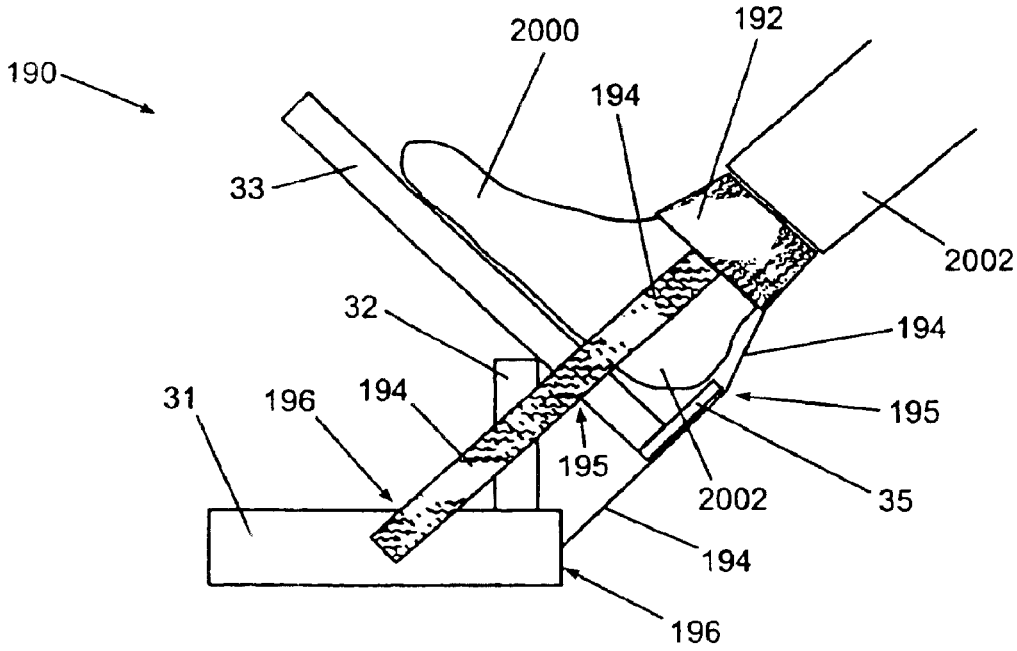

FIG. 12 shows an alternate heel lock apparatus 190, which includes a heel lock feature by use of an ankle cuff 192 which is attached to the foot pad 33 by adjustable straps such as generally shown as 194. By adjusting the straps the heel 2001 of the foot 2000 of the leg 2002 of the user can be "locked" relative to the foot pad 33. Another use of the straps 194 is to provide adjustable connections between points 195 and 196, so as to also function to secure the position of the foot pad 33 relative to the sliding mount 31 of the foot support carriage assembly. Note the side and rear straps are shown; a "front" strap would also likely be used in order to provide adequate locking of the foot pad 33 as desired.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

General Operation

Generally described, the present invention is provided by an overall orthotic apparatus 10, which includes the following components:

a frame 20;

a foot support carriage assembly 30;

a linear force output assembly 40;

a fluid pump and diversion assembly 50;

a manual pump member 60; and a spring return apparatus 70.

A chair 5 is used in conjunction with apparatus 10 according to the present invention. As discussed in further detail below, the chair includes a cross rail which is configured to support the head 22 of the frame 20 of the overall apparatus 10 such that the apparatus is in a relatively inclined position as shown in FIGS. 1 and 2, and such that the apparatus 10 is detachably attached to the chair.

Detailed Discussion

More details are now provided.

Elements List

The overall list of elements discussed herein includes the following:

5 Chair
6 Chair leg
7 Chair seat
8 Chair cross member
9 Supporting surface
10 Overall apparatus
20 frame
  21 spine
  22 head
  22P slotted plates
  23 foot
  24 linear travel markings
  25 slotted plate holes
30 foot support carriage assembly
  31 sliding mount
  32 pedestal
  33 foot support pad (a.k.a. foot support plate)
  34 toe capture member
  35 heel stop
40 linear force output assembly
  41 piston shell (a.k.a. "cylinder")
  42 piston rod
50 fluid pump and diversion assembly
60 manual pump member
70 Spring return apparatus
90 Heel lock apparatus
100 Switch
101 Switch toggle
190 Alternative Heel Lock
192 Ankle apparatus cuff
194 Straps
195 Point
196 Point
1000 user
1001 user right leg
1002 user left leg
1003 user right hand
1004 user left hand
1005 user right foot
1006 user left foot The Overall Apparatus 10

As noted above, the overall apparatus 10 includes a frame 20, a foot support carriage assembly 30, a linear force output assembly 40, a fluid pump and diversion assembly 50, a manual pump member 60, and a spring return apparatus 70.

The Frame 20

Referring generally to FIGS. 1–4, The frame 20 includes a generally elongate spine 21, a head 22, a foot 23, and linear travel markings 24. The frame 20 is configured to remain relatively stationary when the apparatus is being used. The linear travel markings 24 are configured to allow a user to determine the extent to which the foot support carriage assembly 30 has moved relative to the spine 21 of the frame 20.

The spine 21 is generally elongate, and has the head 22 fixed at one end and the foot 23 fixed at the other end. When installed, the spine 21 of the frame 20 is slightly inclined upwardly from the foot to the head ends.

The head 22 includes a pair of slotted plates 22P, each providing a slot, with each slot configured to accept a cross member (or bar) 8 of a conventional folding chair such as shown in FIG. 3. As may be seen, the cross member 8 extends between the two rear legs 6 of the chair and is substantially horizontal and transverse to the spine 21 of the overall apparatus when the overall apparatus 10 is in use. As will also be seen, this allows for a significant amount of opposing forces to be applied to the back of the chair and the foot support pad of the apparatus. Furthermore there can be holes 25 (see FIG. 3) in cross member 8 the head member of the apparatus 10 which allow for plastic or other suitable tie wraps (not shown) to be placed in such a manner as to lock the cross member 8 of chair 5 to the apparatus.

The foot 23 of the frame is likewise generally elongate, and extends relatively transverse to the longitudinal axis of the elongate spine 21. The foot 23 is configured to provide stability at the point at which the frame 20 contacts a typical supporting surface. Therefore it may be seen that the frame 20 is supported at two general locations, the head 22 (resting on the chair) and the foot 23 (resting on the supporting floor surface).

Foot Support Carriage Assembly 30

The foot support carriage assembly 30 is configured to slide along a track defined by and relative to the frame 20. Particularly, the linear force output assembly is configured to slide along a relatively straight axis, which is parallel to the longitudinal axis on the elongate spine 21 of the frame 20. The foot support carriage assembly 30 includes a sliding mount 31, a pedestal 32, a foot support pad 33, a toe capture member 34, and a heel stop 35.

The sliding mount 31 of the foot support assembly 30 is configured to slide relative to the spine 21 of the frame 20 by the use of nylon bearings or other suitable means known in the art.

The pedestal 32 of the foot support assembly 30 extends substantially vertically upwardly from the sliding mount 31, and is relatively rigidly mounted relative to the sliding mount 31.

The foot support pad 33 is pivotably attached relative to the upper end of the substantially vertical pedestal 32, such that as a user flexes his/her ankle, the foot support pad may be pivoted about an axis which is relatively transverse to the longitudinal axis of the spine 21. In the preferred embodiment, the foot support pad is pivotable about a substantially horizontal axis which is transverse to the longitudinal axis of the spine 21.

As may be understood, the foot support pad 33 is configured to support and be in contact with the sole of the shoe of a user, although of course a bare or stocking foot may be used as well.

Toe capture member 34 is configured to be releasably but slidably mounted relative to along a portion of the length of the support pad 33. The heel stop 35 is relatively rigidly mounted relative to the foot support pad 33. The toe capture member 34 is configured to combine with the heel stop 35 to allow the foot support carriage assembly 30 to capture the foot of a user.

It may be understood that, by tightening and loosening suitable clamping members, the location of the toe capture member 34 may be adjusted along the length of the somewhat elongate foot support pad 33. Therefore, it may be further understood that this foot support pad system may be adjusted depending on the size of the user's foot as needed in order to engage the wear's foot relative to the carriage assembly 30.

When in operation, the foot support pad 33, toe capture member 35 and heel stop 35 combine to pivot together as needed. When the invention is used in "knee flex mode" (as a "Knee Flexionater™") the foot support pad is allowed to pivot relative to the linear force output assembly. This allows the ankle to become more plantar flexed as the knee is flexed (the foot support pad moves toward the chair). When the invention is used in "ankle flex mode (as an "Ankle Flexionater™") the foot support pad is fixed in a particular angle with respect to the linear force output assembly. The angle is set dependent upon the patient and his/her situation. With the foot support pad fixed (unable to pivot) the ankle joint is forced into dorsiflexion as the knee is flexed (the foot support pad moves toward the chair). This process is best visualized by the angles of an accordion as shown in FIG. 11. When the accordion's bellows are stretched fully (as in Version "A") out the angle between each bellow is wide but when the accordion's bellows are squeezed tightly together (as in Version "B") the angle between each bellow is very acute. The same occurs with the hip, knee and ankle. As the foot pad is moved toward the chair the hip and the knee are necessarily flexed, and, as follows, the ankle must flex also, if the foot pad angle is fixed.

Linear Force Output Assembly 40

The linear force output assembly 40 includes a piston shell 41 and a piston rod 42. In practice, the linear force output assembly 40 is a hydraulic cylinder.

The linear force output assembly 40 is attached with one end to the foot support carriage assembly 30 and with the other end to the frame 20 of the apparatus 10. The linear force output assembly 40 is configured to provide opposing (pulling) forces at each of its ends, and opposing pushing forces in certain variations. In the configuration shown, this allows a force to be provided on the foot support carriage assembly 30, which causes the foot support carriage assembly 30 to be moved along a straight axis in a reciprocating manner along the spine of the frame 20. As will be discussed in later detail, the linear force output assembly 40 is configured to be moved upon the movement of a manual pump member 60 by the user.

Fluid Pump and Diversion Assembly 50

The fluid pump and diversion assembly 50 is comprised of a plurality of hoses, valves, etc., which provide a pumping action to a fluid as needed, as well as providing various diversions of the flow of the fluid within the fluid pump and diversion assembly.

The manner in which the fluid pump and diversion assembly 50 can operate includes several versions, all of which include the use of a hand pump, a reservoir tank, a main piston (e.g., 40) and a switch (e.g., switch 100 having a toggle element 101).

Version One (Old FIG. 24)—Version One is a first configuration, shown in FIG. 7.

Version Two is shown in FIG. 8 (Old FIG. 25)—In Version Two, no spring return is used. The hand pump is used to pressurize the right side of the cylinder, thus moving the piston rod towards the left as the figure is viewed (thus further bending the knee) when the switch is in the "pump" position (toggle switch shown in solid line). This dumps fluid in the left portion of the cylinder in a line leading towards the tank. When the switch is in the "release" position (toggle switch shown in dotted line), pressure within the main piston cylinder is equalized between both compartments. As more fluid is pumped into the system the differential between the area of the side of the internal piston without the pump rod the area with the pump rod causes the rod to extend eliminating the need for a spring return.

Version Three is shown in FIG. 9 (Old FIG. 26)—In Version Three, the use of the switch allows the user to pump the knee into extension, obviating the need for a spring return.

Version Four is shown in FIG. 10 (Old FIG. 27)—Version Four likewise includes the use of the switch which allows the user to pump the knee into extension, obviating the need for a spring return.

Manual Pump Member 60

The manual pump member 60 is essentially a hand-held lever which extends relatively upwardly from the fluid pump and diversion assembly 50. In practice, this member 60 may be pivoted by a point adjacent to somewhat above the spine 21 of the frame 20, but it may also be allowed to pivot "side-to-side" as needed in order to allow some leeway for the user to allow use of the manual pump member by either the right or left hand as needed.

Spring Return Apparatus 70

The spring return apparatus 70 provides a spring return feature by use of a string wound on a reel, with the reel being spring loaded by use of a torsion or other suitable spring. The frame of the spring return apparatus 70 is mounted relative to the frame of the overall apparatus 10. In the preferred embodiment the spring return apparatus 70 provides a substantially constant five-pound force on the foot support carriage assembly 30 relative to the frame of the apparatus.

Use in Conjunction with Chair

One important feature of the invention is its use in conjunction with a chair such as 5.

As may be understood, this allows for separation of the elements 5, 10, to allow for separate and easy storage. Reference is made to FIG. 3 to show the manner and direction of installation, which is simple yet very effective. Disinstallation is the opposite of installation.

Operation

In order to operate the device, the following steps are typically used.

The user situates the apparatus 10 relative to the chair 5 as shown in FIG. 1. The user is then seated in the folding chair 5, such that the sole of the user's foot is situated atop the foot support pad 33 of the foot support assembly 30. The user then manipulates and secures the toe capture member 34 such that the toe capture member combines to capture the foot of the user when used with the heel stop 35.

The user typically will place the foot atop the foot support carriage assembly 30 when the user's foot is relatively extended. The switch 100 according to the present invention is then positioned to its "closed" position by manipulation of the toggle element 101.

The manual pump member 60 is then pivoted in a reciprocating manner, to provide a "pumping" action to a hydraulic pump so that fluid is moved from the pump under pressure to the linear force output assembly 40, causing the linear force output assembly to stroke in its out erection.

Such stroking causes the fluid support assembly to move towards the chair, such that the user's leg tends to be bent. As may be understood, eventually the user may encounter some pain or discomfort as the leg is bent. When the user can no longer sustain the discomfort, the user is then allowed to "flip the switch" (the toggle 101) of the switch 100, which causes relief on the bent leg.

Referring to FIGS. 2 and 4, movement "A" is linear relative movement between elements 31 and 21. Movement "B" is pivotal movement between elements 33 and 31. This can be fixed or free. Movement "C" is linear sliding movement between elements 34 and 33, which is occasional as needed for adjustment. Movement "D" is relative pivoting movement of element 60 relative to, for example, element 21.

The Heel Lock Feature

The Heel Lock feature of the present invention provides a locking feature to releasably attach the heel of the user relative to the foot support plate 33. This is advantageous in that during the accordion effect, which has been previously described, the heel of the foot in the foot pad will have a strong dorsiflexion moment applied across the ankle during the process. Since dorsiflexion is the intended motion to obtain during the treatment process due to the lack of same, the heel will have a force pushing it out of the foot pad. This heel lifting force is counteracted by a heel lock feature. This heel lock feature can be composed of a clamp on a shoe sole, clamp on a heel cup of a shoe or a harness type of strap around the ankle holding the heel down to the foot pad.

The Toe Capture Feature

As noted above, the toe capture member 34 is configured to be releasably but slidably mounted relative to along a portion of the length of the support pad 33. The heel stop 35 is relatively rigidly mounted relative to the foot support pad 33. The toe capture member 34 is configured to combine with the heel stop 35 to allow the foot support carriage assembly 30 to capture the foot of a user. This provides for an advantageous Toe Capture feature which provides improved operating characteristics. As the footpad is moved towards the chair the knee is flexed. During this process the footpad, if allowed to pivot freely, moves into a position parallel with the linear force output assembly. When the footpad is parallel to the application of force used to move the footpad toward the chair, the foot will slide out of the footpad negating the applied flexion moment at the knee without the use of the toe capture feature. With the toe capture feature the pressure on the foot is maintained.

The toe capture feature is only needed when the device is used as a Knee Flexionater.

The Ankle Lock Feature

As noted above, the foot support pad 33 is pivotably attached relative to the upper end of the substantially vertical pedestal 32. The Ankle Lock feature of the present invention provide a locking feature to releasably fix the position of the foot support pad relative to the pedestal 32 as well as the sliding mount 31 This is advantageous in that it is essential to the accordion effect. The foot support pad must be angularly fixed with respect to the slide mount 31 during operation of the device in order for the accordion effect to exert a dorsiflexion moment at the ankle. This ankle lock feature must be allowed to fix this angle at any angle in accordance with the needs of the patient.

Note again that the Heel Lock and Ankle Lock features must be used together when the device is used as an Ankle Flexionater.

For use of the Ankle Flexionater™ the clinician sets up the device by extending the leg and fixing the angle of the foot plate at a comfortable position for the patient. The Heel Lock™ is then clamped around the sole or last of the heel of the patient's shoe or a harness as discussed later is attached to the ankle and attached to the foot pad. The toe clamp is not necessary for this process and is moved out of the way. This then allows the patient to slide his shoe down into the adjusted Heel Lock™ clamp during every session to keep the heel of the shoe from raising off of the foot plate during the stretching process. The patient must use a tie up shoe in order to facilitate the use of the clamp system. In cases where the clamp is insufficient a Velcro™, buckle strap, or other suitable system could be used around the ankle as a harness to hold the heel down to the foot plate during the stretching process. The manual pump member is then pivoted in a reciprocating manner similar to the use of the Knee Flexionater™ causing the knee to flex and, due to the biomechanics of the lower extremity, the ankle will be also forced into dorsiflexion.

Alternate Heel Lock and Ankle Lock Configurations

FIG. 12 shows an alternate heel lock apparatus 190, which includes a heel lock feature by use of an ankle cuff 192 which is attached to the foot pad 33 by adjustable straps such as generally shown as 194. By adjusting the straps, the heel 2001 of the foot 2000 of the user can be "locked" relative to the foot pad 33. Another use of the straps 194 is to provide adjustable connections between points 195 and 196, so as to also function to secure the position of the foot pad 33 relative to the sliding mount 31 of the foot support carriage assembly, providing the "Ankle Lock" function as well.

Note the side and rear straps are shown; a "front" strap would also likely be used in order to provide adequate locking of the foot pad 33 as desired.

Furthermore, the ankle lock device could also include a flat circular plate having holes therein, that could be rotated and pinned in position (through the holes) to 33 or 32 in FIG. 2. As an example, the plate could be attached to member 32 with a long pin to attach the plate relative to element 32. It could be a gear mechanism, or toothed clamp. One could imagine a dozen ways to allow the motion between the member 33 and member 32 to be restricted occasionally and released when necessary.

Conclusion

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A device for manipulating the leg of a user, said device for use with a chair positioned atop a supporting surface such as a floor, said chair including at least two legs and an elongate cross member intermediate and connecting said two legs, said elongate cross member positioned a distance front said supporting surface when said chair is positioned atop said supporting surface, said device comprising:

an elongate frame member having a longitudinal axis and a first and a second end, said first end configured to be supported by said supporting surface;

a chair attachment device configured to attach said second end of said elongate frame member to said elongate cross member of said chair positioned a distance from said supporting surface, such that said elongate frame member is inclined relative to horizontal, said chair attachment device including a slot configured to accept said elongate cross member of said chair;

a leg manipulating device movably and slidably attached relative to said elongate frame member along a substantially linear axis, said axis being substantially parallel to said longitudinal axis of said elongate frame member, said manipulating device including a leg supporting portion configured for selective attachment to said leg of said user, said leg supporting portion likewise configured to move along a substantially linear axis, said axis being substantially parallel to said longitudinal axis of said elongate frame member, said leg manipulating device configured to move relative to said elongate frame member while said elongate frame member has its said first end in contact with said supporting surface and said elongate frame member is stationary; and a control device operably associated with said manipulating device, said control device configured to be operated by said user while said user is sitting in said chair, such that said user may manipulate said leg while sitting in said chair by use of said control device to move said leg manipulating device relative to said elongate frame member while said elongate frame member is stationary and in contact with said support surface, but subsequently may detach said device from said chair for separate storage.

2. The device of claim 1 wherein said chair attachment device defines at least one hole configured to facilitate attachment of said attachment device to said cross member.

3. A device for manipulating the leg of a user, said device for use with a chair positioned atop a supporting surface such as a floor, said device comprising:

an elongate frame member having a longitudinal axis and a first and a second end, said first end configured to be supported by said supporting surface;

a chair attachment device configured to attach said second end of said elongate frame member to a portion of said chair positioned a distance from said supporting surface, such that said elongate frame member is inclined relative to horizontal;

a leg manipulating device movably and slidably attached relative to said elongate frame member along a substantially linear axis, said axis being substantially parallel to said longitudinal axis of said elongate frame member, said manipulating device including a leg supporting portion configured for selective attachment to said leg of said user, said leg supporting portion likewise configured to move along a substantially linear axis, said axis being substantially parallel to said longitudinal axis of said elongate frame member, said leg manipulating device configured to move relative to said elongate frame member while said elongate frame member has its said first end in contact with said supporting surface and said elongate frame member is stationary;

a hydraulic pump and associated hydraulic fluid lines; and a control device operably associated with said manipulating device and including a pivoting lever operably associated with said hydraulic pump, said lever configured to be pivotably moved by the hand of said user, said control device configured to be operated by said user while said user is sitting in said chair such that pivoting of said lever by said user causes said hydraulic pump to provide a hydraulic pumping action configured to cause movement of said leg manipulating device;

such that said user may manipulate said leg while sitting in said chair by use of said control device to move said leg manipulating device relative to said elongate frame member while said elongate frame member is stationary and in contact with said support surface, but subsequently may detach said device from said chair for separate storage.

* * * * *

UNITED STATES PATENT AND TRADEMARK OFFICE

CERTIFICATE OF CORRECTION

PATENT NO. : 6,872,186 B2
DATED : March 29, 2005
INVENTOR(S) : Branch et al.

It is certified that error appears in the above-identified patent and that said Letters Patent is hereby corrected as shown below:

Column 10,
Line 61, "front" should read -- from --.

Signed and Sealed this

Second Day of August, 2005

JON W. DUDAS
*Director of the United States Patent and Trademark Office*